United States Patent [19]

Delgado

[11] Patent Number: 5,003,750

[45] Date of Patent: Apr. 2, 1991

[54] METHOD FOR REDUCING IMMUNOGENIC AND/OR TOXIC SUBSTANCES IN INDOOR AIR

[76] Inventor: Alex V. Delgado, 6732 N. Hillpark Ave., Parker, Colo. 80134

[21] Appl. No.: 437,671

[22] Filed: Nov. 16, 1989

[51] Int. Cl.[5] ..... E04B 1/00; E04B 1/70; E02D 17/02; E04F 17/00

[52] U.S. Cl. ..... 52/742; 52/169.1; 52/169.5; 52/169.14; 52/303

[58] Field of Search ..... 52/169.1, 169.5, 169.11, 52/169.14, 480, 742, 303

[56] References Cited

U.S. PATENT DOCUMENTS

| | | | |
|---|---|---|---|
| 530,646 | 12/1894 | MacLeod | 52/742 |
| 3,020,618 | 2/1962 | Eward | 52/169.5 X |
| 3,287,866 | 11/1966 | Bevilacqua | 52/169.14 X |
| 4,075,810 | 2/1978 | Zakrzewski | 52/169.5 X |
| 4,078,347 | 3/1978 | Eastman | 52/169.5 |
| 4,486,986 | 12/1984 | Cosenza | 52/169.15 |
| 4,523,875 | 6/1985 | DiFiore | 52/169.5 X |
| 4,578,912 | 4/1986 | Ericsson | 52/303 X |
| 4,580,487 | 4/1986 | Sosnowski | 52/303 X |
| 4,620,398 | 11/1986 | Wallin | 52/169.1 |
| 4,621,476 | 11/1986 | MacGregor | 52/742 |
| 4,760,674 | 8/1988 | Brand | 52/169.5 |
| 4,798,034 | 1/1989 | Jarnagin | 52/169.5 |
| 4,843,786 | 7/1989 | Walkinshaw | 52/169.5 |
| 4,858,521 | 8/1989 | Heh | 52/169.5 X |

OTHER PUBLICATIONS

Philip K. Hopke, Editor, "Radon and its Delay Products", University of Illinois, (American Chemical Society, Washington, D.C. 1987) pp. 526–586.

*Primary Examiner*—Henry E. Ruduazo
*Assistant Examiner*—Deborah McGann Ripley
*Attorney, Agent, or Firm*—Dorr, Carson, Sloan & Peterson

[57] ABSTRACT

A method for reducing the amount of immunogenic and/or toxic substances in a building's indoor air. The method is particularly directed at reducing the level of gases generated by certain wood and/or petrochemical based building materials. The method also serves to reduce levels of electromagnetic radiation within the building.

6 Claims, 1 Drawing Sheet

METHOD FOR REDUCING IMMUNOGENIC AND/OR TOXIC SUBSTANCES IN INDOOR AIR

FIELD OF THE INVENTION

The present invention generally relates to methods for reducing levels of immunogenic and/or toxic substances in the indoor air of houses, commercial buildings and the like. In some of its more preferred embodiments this invention also relates to reducing levels of electromagnetic radiation in such buildings.

BACKGROUND OF THE INVENTION

The National Academy of Sciences and the Environmental Protection Agency have reported that up to 15% of the general population may have heightened sensitivities to low levels of certain gases which are exuded, over time, from many commonly used construction materials and which eventually become constituents of the internal atmosphere of virtually every kind of building constructed according to past or present construction methods. Persons having such increased sensitivities generally react to such gases much in the same way as those who are allergic to pollens, molds, dust, insects, and animal danders. That is to say that such gases act as immunogens; i.e., capable of inducing and perpetuating undesired immunological responses in susceptible individuals. Very often those individuals who are allergic to pollens, molds, etc. are also sensitive to such gases. To a large extent such findings were the motivating force behind legislation (e.g., U.S. Senate Bill 657) designed to address this problem.

Unfortunately, most of that segment of the population predisposed toward such susceptibilities are often particularly sensitive to those gases given off by many petrochemicals commonly used in the manufacture and/or coating of a wide variety of construction materials. For example, many wood and lumber products used in framing buildings of all kinds are usually treated with various petrochemicals during the course of their manufacture. Moreover, some woods, and especially certain soft woods (e.g., cedar, redwood and certain conifers), also give off gases of certain of their natural constituent chemicals (e.g., terpenes) and such gases are generally regarded as being particularly harmful to those having such chemical susceptibilities. Other naturally occurring gases which are often associated with buildings (e.g., radon and methane) emanate from the ground and accumulate in the building's atmosphere, especially in basement areas. Gases of these kinds are generally regarded as being toxic to all members of the general population. Therefore, and particularly in regard to the matter of housing people having known chemical susceptibilities, not only should new buildings be designed with a view toward dealing with any specific known chemical sensitivities and/or allergic conditions of the intended occupants, they also should be designed with a further view toward minimizing any less severe, but still undesirable, immune response reactions and/or any general toxic reactions in the more general population.

At this point perhaps it should be noted that although certain terms such as "immunogen", "allergen", and "antigen", are frequently used interchangeably when discussing undesirable immune responses, these terms are not necessarily synonymous. Immunogenicity, for example, may be defined as the capacity of a substance to initiate a humoral or cell-mediated immune response, whereas antigenicity may be defined as the capacity of a substance to bind specifically with those antibody molecules whose formation it has elicited. The word ligand also has been employed to describe the latter property of specific binding to antibodies. Employed precisely, the term immunogen also specifies that a substance acts at the afferent limb of the immune response. Those skilled in the medical arts will also appreciate that many antigens will possess both immunogenic and antigenic capacities, even though, in some instances, these two attributes may not be apparent due to a state of immunologic unresponsiveness or due to a genetic inability of certain human beings to respond to certain antigens.

Similarly, those skilled in the medical arts will also recognize that allergens are a special group of antigens which are innocuous to the majority of the population, but which may nonetheless cause disease when predisposed individuals are exposed to them by inhalation, ingestion, injection, or by contact with the skin surface. Allergens may be very large molecules such as proteins, polysaccharides, polypeptides and polynucleotides (a large majority of the common, naturally occurring allergen substances such as ragweed, grass pollens and the like usually have rather complex molecules having molecular weights of up to 40,000 and they frequently contain both protein and carbohydrate components); or they may be relatively simple, low molecular weight compounds (e.g., terpenes, sulfadiazine, etc.) which usually require an association with protein carrier molecules in order to elicit an immune response, at least during the immunogenic phase.

It should also be noted in passing that many atopic diseases of this kind tend to manifest themselves in individuals with a hereditary predisposition to produce IgE reaginic antibodies on exposure to such environmental allergens. There is also a great deal of evidence to suggest that atopic individuals may have an increased sensitivity to certain chemical mediators of allergic reactions such as histamine, acetylcholine or prostaglandins. Nonetheless, all of the above differences notwithstanding (or unless otherwise stated), the terms immunogen, allergen and antigen will be used more or less interchangeably throughout this patent application when describing substances having immunogenic capacities, antigenic capacities and/or allergenic capacities. It also should be noted at this point that applicant may also use the terms "hypoimmunogenic", "nonimmunogenic" and like terms of diminution or negation of the subject of immunogenicity in order to describe certain materials employed in, as well as certain environmental conditions achieved by, the practice of the herein disclosed methods of construction.

In all cases however, in considering the action of immunogens, antigens and/or allergens in either atopic or in normal individuals, the portal of entry of such immunogenic substances is of great importance; and it cannot be gainsaid that those individuals who are genetically or otherwise predisposed to the development of such atopic reactions are usually sensitized by exposure to an immunogen by way of the bronchial mucosae. There still exist some questions as to whether or not a specific form of interaction between the mucosal lining and the immunogen (or a defect in mucosal integrity) is required for a material to enter the body in an immunogenic form; but regardless of the answers to these questions, almost all would agree that provision of an environment with reduced levels of gaseous immunogenic substances can only serve to help hypersensitive individuals as well as the more general population.

SUMMARY OF THE INvENTION

Obviously, many operations, processes and components go into the overall construction of those types of buildings typically inhabited by human beings. However, applicant has found that through the use of certain hereinafter disclosed subprocess of the overall construction process, levels of certain immunogenic substances which would otherwise find their way into a building's atmosphere can be greatly reduced. Most of the immunogenic substances reduced in, or eliminated from, the atmosphere of a building constructed according to the herein disclosed process are those substances which either emanate from the underlying soil of the construction site and/or which emanate from the construction materials employed. Use of the herein disclosed construction methods also concomitantly serves to reduce levels of electromagnetic radiation within such buildings.

The herein disclosed construction methods are perhaps best discussed in conjunction with a more or less sequential series of construction steps which respectively deal with a series of environmental problems in order to achieve greatly reduced levels of immunogenic substances, toxins, microbiological fungi and/or electromagnetic radiation in the resulting building. Stated in its most fundamental form applicant's process (or subprocess) in the overall construction of a building starts with selection and excavation of a building site. This is followed by a laying of a gravel bed on the area of the earth which is to be covered by the proposed building. Such a gravel bed serves to define a gas permeable body, and hence a gas permeable path, through which any gases emanating from underlying areas of the earth can be directed in a generally horizontal direction. The outer perimeter of the resulting gravel bed is then surrounded with a gas permeable pipe having permeations which permit fluid communication, and especially gas flow communication, between the gas permeable pipe and the gas permeable path created by the gravel bed. The gas permeable pipe is ultimately vented to the earth's atmosphere. Such venting can be accomplished by either natural drafts or artificial drafts such as those produced by fans, pumps and the like.

The gravel bed is then covered with a gas impermeable material in such a manner that it establishes a substantially monolithic, gas impermeable barrier to any gases emanating from the underlying earth. Such a barrier can be fashioned from rolls or sheets of any number of well known thermoplastic polymer materials such as, for example, polyethelene. After the gas impermeable barrier is so positioned, a layer, and most preferably a monolithic layer, of concrete is poured over the gas impermeable barrier in order to establish a ground floor of the building. Such a layer of concrete should be at least three inches in thickness.

Thereafter an aligned array of vertical joist elements (wherein a major fraction of the individual joist elements making up the array are made of a metallic material as opposed to say pine 2×4's) are erected in order to provide vertical support for an outside wall of said building. Horizontal roof joists, if employed in the particular building, should be made of like materials. Once the joists are in place, sheets of a flat, wall forming construction material such as plywood, particle board and the like are then attached to the joists in a vertical orientation in order to form a first layer of the inside surface of the exterior wall. Thereafter, a layer of a metallic, gas impermeable material is placed over the first layer of the inside wall construction material in order to form a second inside layer of the exterior wall, ceiling, etc.

Any holes in the metallic, gas impermeable material, e.g., holes made by the fastening means which hold the metallic, gas impermeable material to particle board, plywood, etc., such as those made by nails, staples, etc., as well as any larger holes made for electrical and plumbing lines and the like, should then be made air tight by use of appropriate covering materials such as tape or additional layers of the same or like metallic, gas impermeable materials and thereby render the entire layer of gas impermeable material which then covers the interior side of the exterior wall, ceiling, etc., "air tight". That is to say the layer of gas impermeable material will not permit gases emanating from construction materials outside of the gas impermeable barrier to leak into the interior atmosphere of the building. Obviously, these techniques can also be employed in constructing interior walls as well. Finally the layer of gas impermeable material is covered with a wall forming material such as sheets of dry wall, tile, glass and the like in order to complete the inside surface of the wall. Obviously care should be taken so that any nails, staples, etc. which are used to erect the dry wall are driven only into the joists and do not otherwise perforate the gas impermeable material and thereby destroy its integrity as a gas barrier. The outside surface of the exterior wall may be covered by brick, veneer, etc. by known construction techniques which do not necessarily form a part of the herein disclosed methods of construction, but which nonetheless may embody certain preferred techniques for the construction of said outside surface.

DESCRIPTION OF THE PREFERRED EMBODIMENTS

Figure 1:
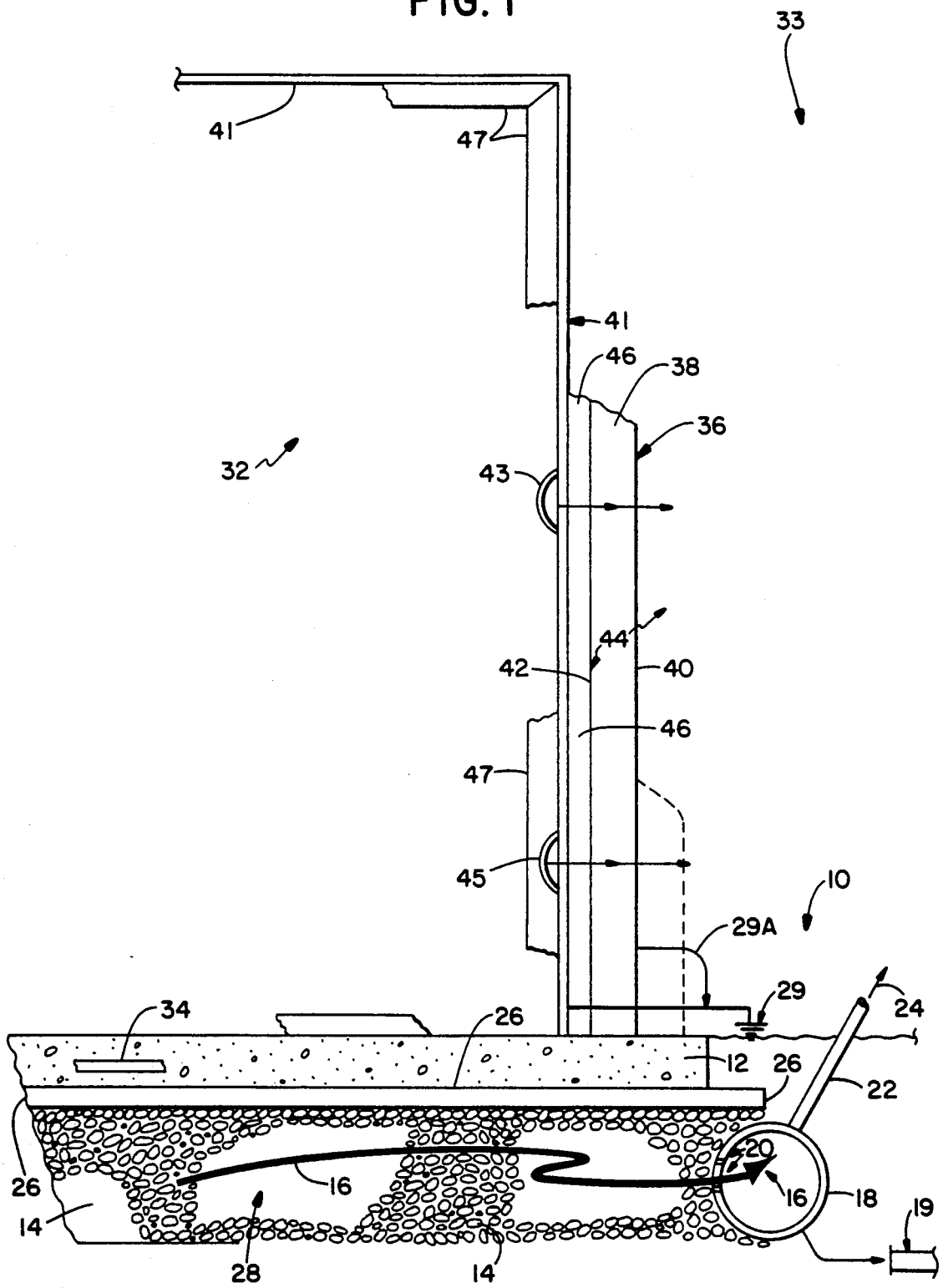
FIG. 1 shows a cross sectional view of a building constructed according to the herein disclosed methods.

Referring now to FIG. 1, and again starting at the ground floor level and working upward, one can begin a more detailed discussion of some of the more preferred embodiments of the herein disclosed construction process by first noting a provision of means for dealing with any potential gas hazards emanating from the earth underlying the building site. Radon and methane are perhaps the two most common hazards of this kind.

Radon is of course a colorless, odorless, tasteless radioactive gas that occurs naturally, at various levels, in soil gases, underground water, and outdoor air. Prolonged exposure to elevated concentrations of radon decay products has long been associated with increases in the risk of lung cancer in the entire general population. Elevated concentrations are usually defined as being at or above the Environmental Protection Agency (E.P.A.) suggested guidelines of 4 pCi/l or 0.02 WL average annual exposure. The abbreviation pCi/l stands for pico Curies per liter and is frequently used as a radiation unit of measure for radon. WL is an abbreviation for Working Level and it is often used as a radiation unit of measure for the decay products of radon. The relationship between the two terms is generally 200 pCi/l=WL. Although exposure below this level may present some risk of lung cancer in the general population, reductions to lower levels may be difficult and sometimes impossible to achieve since radon does exist in the earth's atmosphere. However, in the atmosphere, it is diluted to such low concentrations that it does not present a known health hazard. Radon does however represent a hazard in some indoor atmospheres. For example some public and private well water supplies represent hazards simply because they contribute to indoor radon gas concentrations. Hence, when such water is heated and/or agitated, as in a shower or washing machine, it will often give off small quantities of radon. The generally accepted rule of thumb for emanation of radon gas from such water is that each 10,000 pCi/l of radon in water introduced into a building will normally, upon being drawn, produce a concentration of about 1 pCi of radon in the building's indoor air.

Consequently, perhaps the most important radon related criteria in selecting a building site is simply to determine beforehand, to the degree possible, the general potential for radon hazards at the particular building site and then avoid any hazardous site if at all possible. Unfortunately, there are no readily employable, standard soil tests or specific standards for correlating the results of soil tests at a particular building site in order to accurately estimate eventual indoor radon levels. Moreover, the great variety of geological conditions will probably continue to preclude establishment of any all inclusive, nationwide, standards for such correlations. One can, however, roughly assess the radon potential at a given building site based upon factors other than soil tests. For example, one can simply inquire as to:

(a) whether or not existing homes in the same geologic area have experienced elevated radon levels. The term "same geologic area" should generally be taken to mean an area within roughly ten miles and having substantially similar rock and soil composition characteristics;

(b) the general characteristics of the local soil. For example one might inquire as to whether or not the soil derived from underlying rock normally contains above average concentrations of uranium or radium; e.g., certain granites, black shales, phosphates or phosphate limestones are known to have such characteristics;

(c) whether or not the permeability of the soil and underlying rock are conducive to the flow of radon gas? Soil permeability (influenced by grain size, porosity, and moisture content) and the degree to which underlying and adjacent rock structures are stable or fractured can significantly affect the amount of radon that can flow toward and ultimately into a structure; and (d) whether or not the source of water to the proposed building site is going to be a local or on-site well. This of course is done to gain some idea as to whether or not excessive levels of radon can be expected based upon known detections of radon in other wells within the same general geologic area? As previously noted, radon levels measured above 40,000 pCi/l of water could, in and of themselves, produce indoor radon concentrations of about 4 pCi/l. Again, such a level generally should be regarded as excessive.

Assuming there are no known excessive local radon and/or other local gas hazards (e.g., those due to methane), one begins the practice of this invention by excavating a local site 10 such as the one depicted in FIG. 1 in order to receive a gravel bed 14 upon which a ground floor concrete slab 12 will be placed. Well anchored soil of a homogenous content, such as clay, uniform sand, or rock-like structure is highly desirable. The site should of course have a soil having sufficient load bearing ability to support the proposed structure. Test borings should be used to determine the proximity of any rock and/or water levels. The building should be positioned in a negative flow environment, which implies that all water should flow away from the building site. The exact depth of the foundation may well be predetermined by the elevation of the site.

Subsurface drainage systems which allow subsurface water to flow away from the site also can be employed. Such precautions deter any water dam-up behind a foundation wall and can cause hydrostatic pressure, which ultimately serves to work water between blocks (in the case of cement block construction) or under a monolithic wall, especially at the point where a wall rests on its base. Any underground section of a foundation wall must be damp proofed. This preparation is best done by first providing the entire area under the proposed ground floor concrete slab 12 with a layer of at least 3 inches in depth (and preferably between about 4 to about 6 in depth) of a gravel or gravel-like material to form the gravel bed 14 (e.g., pea gravel or a large, aggregate bed can be employed) in order to establish a substantially horizontally oriented ventilation path 16 under the ground floor concrete slab 12. The gravel should itself be comprised of stones which themselves are made free of (as by washing or otherwise) any immunogenic substances. Again, it should be noted that gravel, crushed stones, sand, water and gypsum board may themselves have significant radon levels which could preclude their use as construction materials. Local, natural stone, particularly granite, also may have high radon levels. Hence, if a building is being built in an area having some radon, such as some areas of Pa., N.Y. state and Colo., or in Southern Ontario or Quebec in Canada, then use of certain local building materials such as certain local stones should be avoided. Similarly, radon free water should be used in the formulation of any concrete used in the construction process.

In any event, the resulting gravel bed 14 is then surrounded, preferably in a continuous loop configuration, by a perforated conduit pipe 18 such as 4 inch diameter drain pipe having an array of fluid permeable (gas and water permeable) holes 20. As in the case of the material which forms the gravel bed 14, the pipe also should be made of a nonimmunogenic material such as a glazed ceramic material or the like. A vent 22 from the loop of conduit pipe 18 can be directly vented to the outside atmosphere 24 or it can be run into a closed drain or sump area 19 that can, if necessary, be equipped with a fan-driven vent not shown in FIG. 1. The conduit pipe 18 can also be provided with a fluid draining system which leads to a drain or sump area 19. The perforated pipe 18 (made of rigid plastic, clay, cement, etc.) or tube is preferably positioned with at least some of its perforations in a down and/or a side facing position. Most preferably they will be positioned on a 6 to 8 inch bed of clean (radon free) pea gravel. The pipe 18 (or tube) also is preferably positioned just beyond weight of the wall footings. Other pipes can be utilized to connect the perforated pipe 18 with roof drains and to drainage disposal points such as a sump or disposal area 19.

After the gravel bed 14 is laid, a gas impermeable plastic barrier material 26 such as polyethylene is laid over the concrete slab 12 in such a manner as to create a monolithic, gas impermeable barrier. So constructed, such a barrier prevents any gas 28 arising from the earth 30 from reaching, and eventually penetrating, the concrete slab 12. By way of example, strips or sheets of polyethylene material having a thickness of about 6-millimeters ["6-mil"] may be conveniently employed as such a gas barrier so long as the edges of the strips or sheets overlap one another far enough (edge overlaps of about 12 inches will generally suffice) to prevent any rising gases from leaking upward, around the overlaps. In other words, if strips or sheets of the gas barrier material are employed (rather than a large single piece of such material), they should be so overlapped and arranged that they, in effect, form a monolithic, gas impermeable barrier 26 to any undesirable gases 28 such as radon, methane, etc., emanating from the earth 30 underlying the gravel bed 14. To this end, any penetrations of the gas barrier 26 (e.g., by plumbing or electrical conduits) should be sealed or taped to preserve the barrier's gas impermeable integrity. Extreme care also should be taken to avoid puncturing the gas barrier 26 while pouring the concrete slab 12.

It should also be noted that if, in order to reduce major floor cracks through which any arising gases 28 might enter the building's atmosphere, reinforcing means 34 such as steel mesh, or bar, are to be employed, they should be imbedded in, but not placed under, the slab 12 resulting from the concrete pour. When the gas barrier 26 is so adapted and arranged, any gas 28 arising from the earth will tend to be directed through the gravel bed 14 in a generally horizontal plane in the general direction of the gas ventilation path 16 depicted in FIG. 1.

After the gas barrier 26 is in place, a concrete floor slab 12 is then laid over the gas barrier and hence, over the underlying gravel bed 14. Preferably the concrete slab 12 is poured to form a monolithic slab of at least 3 inches thickness up to about 12 inches. Use of a dense cement material, i.e., a cement so finely milled that it is water-impervious is preferred. No cement curing agents (e.g., chlorides) should be employed as cement additives. That is to say that those cement additives which are often employed as cement curing agents should be avoided if at all possible in the practice of this invention. Most preferably, a 100% cementous material, e.g., those cement materials used in trout rearing ponds, should be employed as an ingredient in order to minimize the resulting concrete's nonimmunogenic qualities. In one particularly preferred embodiment of this invention the concrete slab 12 is placed on a 10 mil polyehtylene moisture-radon barrier which is set in about 2 inches of wet sand. The concrete slab 12 preferably is also caulked to an outside wall 36 associated with the slab 12. Slab reinforcement is conveniently carried out with 6"×6", #10 slab reinforcement mesh positioned in the lower half of the slab 12.

Having so laid the foundation slab 12 of the building, the next major consideration in the practice of this invention is the construction of the building's outer walls. To a large degree, the herein disclosed construction process contemplates the use of metal studs in place of those conventional pine 2×4's which are normally used as joists in framing such walls. In other words, it is highly preferred that a major fraction of the joists are made of metal rather than wood. The metal studs may also be electrically grounded as generally indicated in FIG. 1 by grounding element 29A. An aligned array of such metal studs is generally indicated by item number 38 in FIG. 1. This is a preferred step in the herein disclosed process for providing reduced levels of immunogens and/or toxins in the eventual atmosphere of the building simply because many woods (especially pines) are known to outgas large amounts of potentially harmful terpines, sometimes for literally hundreds of years after they are used as such framing elements.

After the vertical joists are positioned, sheets of flat construction material such as plywood, particle board or wallboard are then attached in the inside face edges of the aligned array of joists in order to form a first inside layer 46 of the wall. Perhaps it should also be noted at this point that the glues used in the construction of such plywoods, particle boards, etc. are generally either aminoresins or phenolic resins. Aminoresins are polymeric products of the reaction of an aldehyde with compounds containing an amino group, particularly urea and melamine. In virtually all aminoresins the aldehyde component is formaldehyde and by far the dominant aminoresin is urea-formaldehyde because of its relatively low cost compared to other resins used in wood adhesives. The major disadvantage of aminoresins, especially urea-formaldehyde resins, is that they are not totally water resistant, and consequently their gluelines will eventually delaminate and then release formaldehyde gas during their slow water hydrolysis. This formaldehyde gas represents yet another immunogenic and/or toxic gas hazard which applicant especially seeks to minimize.

Phenolic resins on the other hand are polymeric products of the reaction of an aldehyde with compounds containing a phenolic hydroxyl group. The phenolic component is most often phenol, but may be cresol, resorcinol, or catechol, or the like. The rate of reaction is highly dependent on the relative reactivity of the phenolic substance used. Resorcinol is much more reactive than phenol and consequently is used in "cold-setting" resin adhesives. Catechol is also more reactive than phenol, but somewhat less reactive than resorcinol. The phenolic component used in the manufacture of such resins may also be a mixture of phenolic substances, such as phenolresorcinol resins. Phenol and the other phenolic substances are however considerably more expensive than urea based glues, and formaldehyde is still the most common aldehyde component in such resins (although others such as furfural are occasionally used). Nonetheless, the use of wood products using phenolic resins are highly preferred over those using aminoresins in the practice of this invention because they give weather-and boil-proof gluelines and hence do not tend to release undesirable formaldehyde vapors. Thus in most cases, the most preferred forms of plywood, particle board and the like for the over practice of this invention are those employing phenolic resins in their glues.

In any event, after the inside layer of the exterior walls are so formed they are then covered with a layer of a metallic, gas impermeable barrier material 41. In effect this metallic, gas impermeable material serves the dual purposes of (1) keeping gases emanating from construction materials exterior to (i.e., toward the outside of the building) the metallic, gas impermeable barrier from entering the building's indoor atmosphere and (2) serving as an electrical shield around the entire living space surrounded by the metallic gas impermeable barrier 41. In the most preferred embodiments of this process, the metallic, gas impermeable barrier 41 is electrically grounded as generally indicated by the electrical ground 29 depicted in FIG. 1.

Before leaving the subject of the metallic, gas impermeable barrier 41, used in the herein disclosed construction process, it should be noted that conventional building methods often employ various kinds of foil-faced sheathing board as an exterior moisture-vapor barrier material. This grounding can employ the same ground 29A used to ground the metal studs 38. However, when such a vapor barrier is so positioned on the outside plane 40 of the joists or studs of an exterior wall constructed according to conventional construction techniques, any chemical fumes outgassing from any treated woods, insulation, caulking and electrical wires which are enclosed in, or otherwise associated with, the wall 36 will tend to be forced back into interior atmosphere 32 of said building rather than being forced toward the outside atmosphere 33. If applicant employs such foil-faced sheathing board, as the metallic, gas impermeable barrier material 41, then such employment is with the proviso that metallic, foil-faced sheathing board be placed on the inside edges 42 of the joists 38 rather than on their outside edges 40. The foil side preferably faces the interior of the building. Consequently when any gas barrier material 41 (and especially foil-faced sheathing so employed, with its foil side facing the interior of the building) is so positioned, then any chemical vapors 44 emanating from any construction materials located to the outside of the gas impermeable barrier 41 are much more likely to escape in the direction of the outdoor atmosphere 33. Sheets of such a metallic foil material, if so employed as a gas barrier 41, can be positioned by stapling them to the wallboard material 46 and then sealing any cracks between abutting pieces of sheathing with foil tape or the like in order to maintain their gas barrier integrity. For example, ⅛" foil-faced sheathing board, suitably taped, can be used as such a gas barrier material. Abutting edges are preferably positioned over select joists. The sealing of any holes made in the gas impermeable barrier material 41 is generally depicted in FIG. 1 by the bubble like elements 43 and 45 on the barrier material 41. Finally a layer of inside wall forming material 47 such as sheetrock, tile or the like is then placed over the metallic, gas impermeable barrier material 41.

Thus the most fundamental versions of the herein disclosed method of constructing a building in order to minimize levels of immunogenic substances in the atmosphere contained in the building comprise: (1) excavating an area of the earth upon which the building will be placed; (2) laying a gravel bed in the excavated area of the earth and thereby defining a gas permeable path over which gases emanating from underlying areas of the earth can be directed; (3) surrounding the gravel bed with a pipe having permeations in fluid connection with the gas permeable path defined by the gravel bed; (4) venting the pipe; (5) covering the gravel bed with a gas impermeable material in such a manner that said material establishes a substantially monolithic, gas impermeable barrier to any gases emanating from underlying areas of the earth; (6) pouring a substantially monolithic layer of concrete over the gas impermeable barrier in order to establish a ground floor of the building; (7) erecting an array of vertical joist elements, (wherein a major fraction of the individual joist elements comprising the array are made of a metallic material) in order to provide vertical support for an outside wall of said building; (8) placing a wall forming material on the inside of the vertical joists; (9) placing a layer of a metallic, gas impermeable material on the inside of the exterior wall; (10) electrically grounding the metallic, gas material; and (11) covering the layer of gas impermeable material with sheets of dry wall in order to form an inside wall surface.

Although use of the above-described subprocesses in the overall construction of a building will in and of themselves serve to produce an indoor atmosphere having greatly reduced levels of immunogenic and/or toxic substances, still other nonessential, but nonetheless highly preferred, processes which can be employed to achieve still lower levels of immunogenic and/or toxic substances in the building's inside atmosphere.

For example, with respect to such a building's floors, the most preferred construction materials, from the point of view of the hypoimmunogenic or nonimmunogenic qualities of the materials employed for such floors, are glazed ceramic tiles which are preferably set in Portland cement with Portland cement grouting or, if tolerated, Hydromet® grout. Glazed tile can be mud-set or thin set. When unglazed tile is used, it is preferably thick-set or mud-set into a 1½" bed of moist Portland cement and sand. Such unglazed tiles are more preferably those of uniform size and thick-set or mud-set; or they can be thin-set using a powdered mortar mix combined with water.

Steel channel floor joists can be used (sizes are comparable to wood joists) for short spans. They can be fastened with an all steel clip and screw system or they can be combined with sealed wood or concrete systems. Steel framing systems commonly used for both structural walls and floors can be used for all lightweight non-load-bearing partitions. Such steel systems are especially nonimmunogenic in character and, hence, are especially benign toward those hypersensitive persons who cannot tolerate the terpenes, formaldehydes, etc. which emanate from many soft wood framing members.

Terrazzo is a very nonimmunogenic, and extremely durable and easily maintained floor material. It is also free of porous mortar joints which can absorb spills and permit the growth of undesired molds and bacteria. However, terrazzo is expensive and it generally requires a sealer. When such a sealer is employed, it should be of the acrylic type since acrylic sealers generally have a nonimmunogenic character. When hardwood floors are employed as the flooring material they will preferably employ a tongue and groove method of construction rather than depend upon underlying glues which tend to release extremely large amounts of undesirable immunogenic chemical fumes.

Paints, where employed, should be water based paints free of pesticides, fungicides or biocides. Similarly, while the interior walls are preferably made of brick, rock, porcelain on stainless steel, concrete block, stucco or plasters, they too should avoid the use of fungicides or other biocides as part of their ingredient make-up. Glass walls over preselected wall coverings and glass ceilings are highly preferred materials for most internal wall surfaces. Porcelain or baked enamel over stainless steel also are highly preferred construction materials for the walls and ceilings.

Other materials particularly selected for their hypoimmunogenic or nonimmunogenic properties at various locations in the building might include the following considerations:

Roofing tiles containing no calcium chloride are highly preferred. Underneath such tiles a foil radiant/chemical/vapor barrier may be employed. Galvanized steel, copper, and aluminum are preferred flashing and downspout materials. Shingles of ceramic or clay tiles also can be employed.

Window sills and exposed areas are preferably made of ceramic tile or untreated (i.e., chemically untreated) oak, ash, elm, maple, teak, poplar, and magnolia. Other nonglass portions of the windows should be made of metal. Custom wood frame windows with metal storm windows and screens are also preferred. Doors will preferably be of glass, metal, masonite or solid hardwood.

All electrical wiring should be placed in metal conduit and the use of porcelain socket light fixtures are highly preferred throughout the building. With respect to the incoming plumbing, copper should be used throughout. That is to say that no pipes made of PVC or ABS should be used to convey any in-coming water. Such materials can however be employed for out-going water lines. Copper pipe having joists of the flared type are most preferred since they contain no lead. Drains and vents should be made of copper, brass, and iron. Fixtures should be stainless steel, porcelain, enamelled steel or enamelled cast iron. Moreover, the entire house should be provided with a water purifica-tion unit.

The heating system is preferably of the passive solar, hot water radiant, electric radiant, electric convection heaters baseboard or wall type, or individual heat pumps.

Bathrooms should feature ceramic tile walls, floors and counter tops, porcelain or stainless steel fixtures and metal and/or solid hardwood cabinets. Similarly, the kitchen will most preferably be done using ceramic tile backsplash, counter tops, etc., and porcelain or stainless steel sinks, porcelain lined dishwashers and refrigerators. Preferably, a high CFM vent fan, vented to outside, should vent the cooking stove and all closets. Incidentally, any television sets employed should be enclosed with wire grid glass doors and vented to the outside.

With respect to the outside walls, it will often be desirable to coat such walls with certain nonflammable coating products which are designed to impart water repellence to a wide variety of surfaces. Generally such coating products react with moisture and carbon dioxide in the air to form an insoluble sealer within 24 hours. Tests on various types of masonry have shown that low water absorption properties achieved with such products can be maintained for very long periods of time. Hence, all exterior above grade surfaces may also be treated with this product since it shows very little change in water repellence over long periods of time. As a surface treatment, it also may be used for porous bricks, Mexican-type pavers, concrete blocks, stucco, concrete and raw wood to increase water repellency and reduce water absorption.

Whenever employed, insulation should be of the foamed cement type since it is a less chemically toxic material than most other types of insulation. This material is a light weight cementitious product which is usually foamed in place. The foaming agents in some formulations may however produce certain contaminants; and hence such products should be tested for toxicity. Plastic resin foams (styrene, polyurethane) also are acceptable as an outside foundation insulating barrier. Glass fiber batts and mineral fiber materials are usually acceptable provided that they are fully isolated from the interior environment.

Thus having disclosed my invention, what is claimed is:

1. A method of constructing a building in order to minimize levels of immunogenic substances in the atmosphere contained in the building, wherein a portion of an overall construction process for the building employs a subprocess of construction comprising:

excavating an area of the earth upon which the building will be placed;

laying a gravel bed in the excavated area of the earth and thereby defining a gas permeable path over which gases emanating from underlying areas of the earth can be directed;

surrounding the gravel bed with a pipe having perforations in fluid connection with the gas permeable path defined by the gravel bed;

venting the pipe to the atmosphere;

covering the gravel bed with a gas impermeable material in such a manner that said material establishes a substantially monolithic, gas impermeable barrier to any gases emanating from underlying areas of the earth;

pouring a substantially monolithic layer of concrete over the gas impermeable barrier in order to establish a ground floor of the building;

erecting an array of vertical joist elements, (wherein a major fraction of the individual joist elements comprising the array are made of a metallic material) in order to provide vertical support for an outside wall of said building;

placing a wall forming material on the inside of the vertical joists, and placing a layer of a metallic, gas impermeable material on the inside of the exterior wall;

electrically grounding the metal studs and metallic, gas impermeable material; and covering the layer of gas impermeable material with sheets of dry wall in order to form an inside wall surface.

2. The subprocess of construction of claim 1 wherein the gravel bed defining the gas permeable path is laid to a depth of from about three to about twelve inches.

3. The subprocess of construction of claim 1 wherein the pipe surrounding the gravel bed is (1) provided with permeations which are positioned to face the gravel bed, (2) laid in a continuous loop configuration around the gravel bed and (3) is vented to the atmosphere by means of a mechanical fan system.

4. The subprocess of construction of claim 1 wherein the gas impermeable material used for covering the gravel bed is constructed by laying overlapping strips of polyethelene over said gravel bed.

5. The subprocess of construction of claim 1 wherein the ground floor is provided with steel reinforcement bars and poured to a depth of from about three to about twelve inches.

6. The subprocess of claim 1 wherein the metallic, gas impermeable material placed on the inside of the exterior wall is an array of ⅛" foil-faced sheathing boards whose abuting edges are taped over to provide a gas impermeable barrier.

* * * * *